US006092440A

United States Patent [19]

Hillinger

[11] Patent Number: 6,092,440

[45] Date of Patent: Jul. 25, 2000

[54] SELF-ADJUSTING RATCHETING WRENCH

[75] Inventor: George Hillinger, Los Angeles, Calif.

[73] Assignee: Alltrade Inc., Long Beach, Calif.

[21] Appl. No.: 09/397,988

[22] Filed: Sep. 16, 1999

[51] Int. Cl.[7] ..... B25B 13/28

[52] U.S. Cl. ..... 81/117; 81/99

[58] Field of Search ..... 81/98, 99, 111, 81/117, 186, 418, 424.5, 426

[56] References Cited

U.S. PATENT DOCUMENTS

| | | | |
|---|---|---|---|
| 262,840 | 8/1882 | Simmons et al. | 81/99 |
| 676,318 | 6/1901 | Jackson | 81/99 |
| 739,316 | 9/1903 | Irland | 81/99 |
| 1,454,444 | 5/1923 | Komnenus | 81/117 |
| 1,610,687 | 12/1926 | King | 81/117 |
| 1,634,908 | 7/1927 | Lynch et al. | 81/99 |
| 2,467,658 | 4/1949 | Carnelli | 81/99 |
| 5,829,327 | 11/1998 | Stanton | 81/111 |

*Primary Examiner*—David A. Scherbel
*Assistant Examiner*—Joni B. Danganan
*Attorney, Agent, or Firm*—Robert R. Thornton

[57] ABSTRACT

A self-adjusting ratcheting wrench has an elongated handle terminating at one end in a fixed jaw, a movable jaw pivotally attached to the handle so as to close on the fixed jaw and terminating at one end in a pair of jaw faces forming an obtuse angle and separated from one another by a lateral groove and at the other end in a tail, the pivotal attachment being disposed between the tail and the jaw faces, an actuator arm pivotally attached at one end to the tail and at the other end in a thumb plate and connected therebetween to the handle so that the actuator arm is laterally offset from and longitudinally slidable along the handle, a leaf spring disposed in and pivotally attached to the handle, and a coil spring disposed in the handle so as to urge the leaf spring against a convex camming surface formed on the movable jaw adjacent the tail, whereby torque applied to the handle in a first direction causes the jaws to close on an element contained therebetween so as to apply the torque to the element, torque applied to the handle in the opposite direction permits the jaws to open and the wrench to ratchet about the element, and longitudinal force applied to the thumb plate in the direction of the jaws causes the jaws to open.

8 Claims, 4 Drawing Sheets

SELF-ADJUSTING RATCHETING WRENCH

BACKGROUND OF THE INVENTION

1. Field of the Invention

The present invention relates to wrenches which automatically lock on an element to which torque is to be applied, that is, are self-adjusting, and more particularly to such wrenches which provide a ratcheting function when rotated in the direction opposite that rotational direction which applies torque to the element.

2. Summary of the Prior Art

Self-adjusting wrenches which provide a ratcheting function are well known in the art, and are shown, for example, in U.S. Pat. No. 2,645,145, issued Jul. 14, 1953 to J. V. Larson, in which the wrench has a fixed jaw and a movable jaw which is pivotally connected to the fixed jaw, the jaws being manually openable by pressing on a "trigger" formed as a tail portion of the movable jaw. However, the trigger is located at the end of the wrench handle closest to the wrench jaws, and so normally requires a change in the user's grip on the wrench handle to operate the trigger. The wrench shown in U.S. Pat. No. 4,651,597, issued Mar. 24, 1987 to T. Yang, attempts to overcome this difficulty by providing a slot in the tail portion of the movable jaw and a spring-biased control link within the handle portion of the wrench, the control link having a pin at one end which engages the slot so as to be manually operable to open the jaws. However, this design is somewhat bulky and difficult to manufacture, and has not found widespread use.

SUMMARY OF THE INVENTION

According to the present invention, a self-adjusting ratcheting wrench has an elongated handle terminating at one end in a fixed jaw, with a movable jaw pivotally attached to the handle so as to close on the fixed jaw, said movable jaw terminating at one end is a pair of jaw faces forming an obtuse angle and separated from one another by a lateral groove and at the other end in a tail, so that the pivotal attachment is disposed between the tail and the jaw faces, and an actuator arm pivotally attached at one end to the tail and having a thumb plate at the other end, the actuator arm being attached to the handle so that the actuator arm is laterally offset from and longitudinally slidable along the handle, a leaf spring disposed in and pivotally attached to the handle and a coil spring disposed in the handle so as to urge the leaf spring against a convex camming surface formed on the movable jaw adjacent the tail, whereby torque applied to the handle in a first direction causes the jaws to close on an element contained therebetween so as to apply the torque to the element, and torque applied to the handle in the opposite direction permits the jaws to open so that the wrench ratchets about the element, and longitudinal force applied to the thumb plate in the direction of the jaws causes the jaws to open.

BRIEF DESCRIPTION OF THE DRAWING

The present invention may be more readily understood by reference to the accompanying drawing, in which.

DETAILED DESCRIPTION OF THE PREFERRED EMBODIMENT

Figure 1:
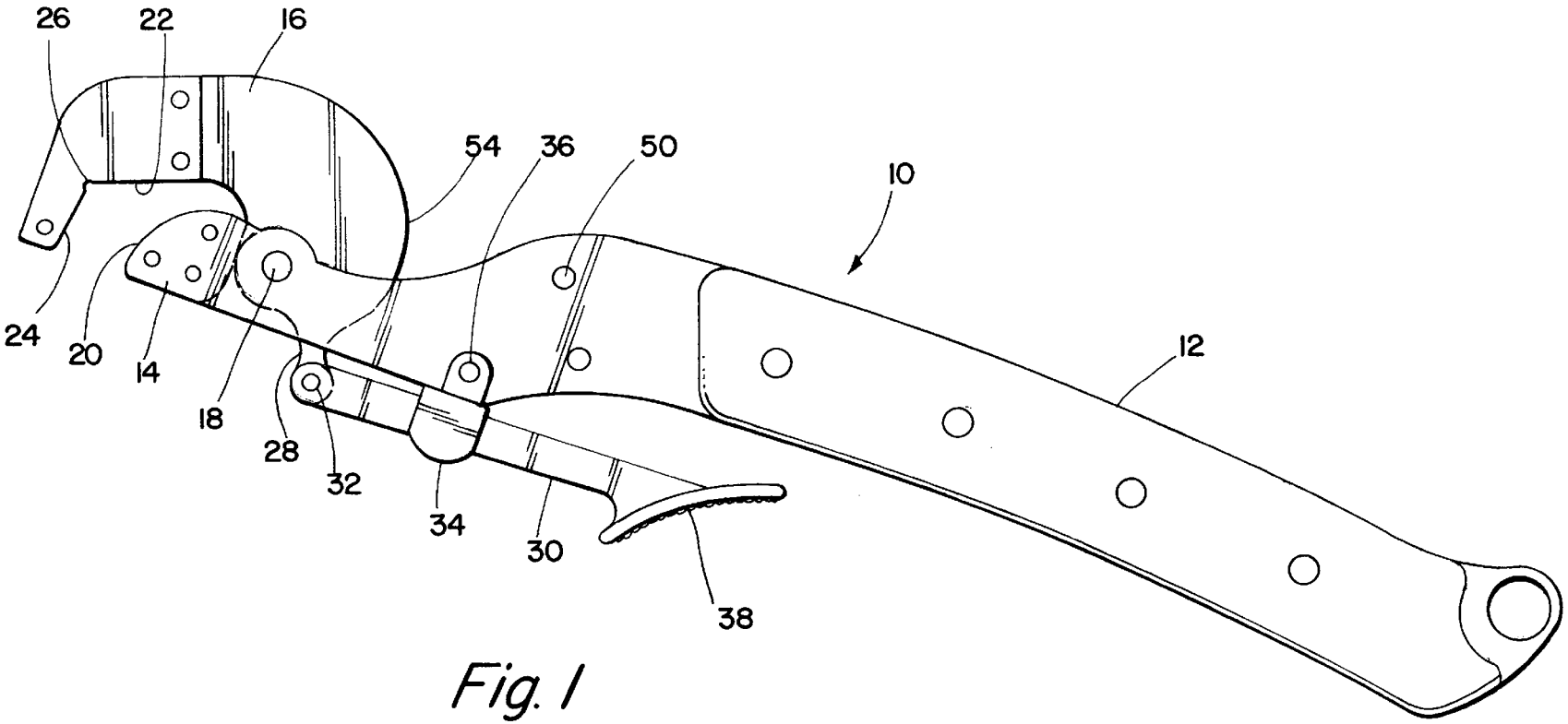
FIG. 1 is a side elevational view of a self-adjusting ratcheting wrench according to the present invention.

In FIGS. 1 through 4, a self-adjusting ratcheting wrench 10 has a handle 12 which terminates at one end in a fixed jaw 14. A movable jaw 16 is pivotally attached to the handle 12 adjacent the fixed jaw 12 by a rivet 18. The fixed jaw 14 has a curvilinear face 20, and the movable jaw 16 has a pair of planar faces 22, 24, which form an angle of one hundred and twenty degrees. The faces 22, 24 are separated from one another by a groove 26, which assists in the ratcheting operation, as is well known in the art. The movable jaw 16 has a tail 28 formed thereon remote from the faces 22, 24, so that the rivet 18 lies therebetween. The tail 28 is pivotally connected to one end of an actuator bar 30 by a rivet 32. The actuator bar 30 extends through an actuator bar guide 34 which is fixed to the handle 12 by a rivet 36. The actuator bar 30 terminates at its other end in a thumb plate 38.

Figure 2:
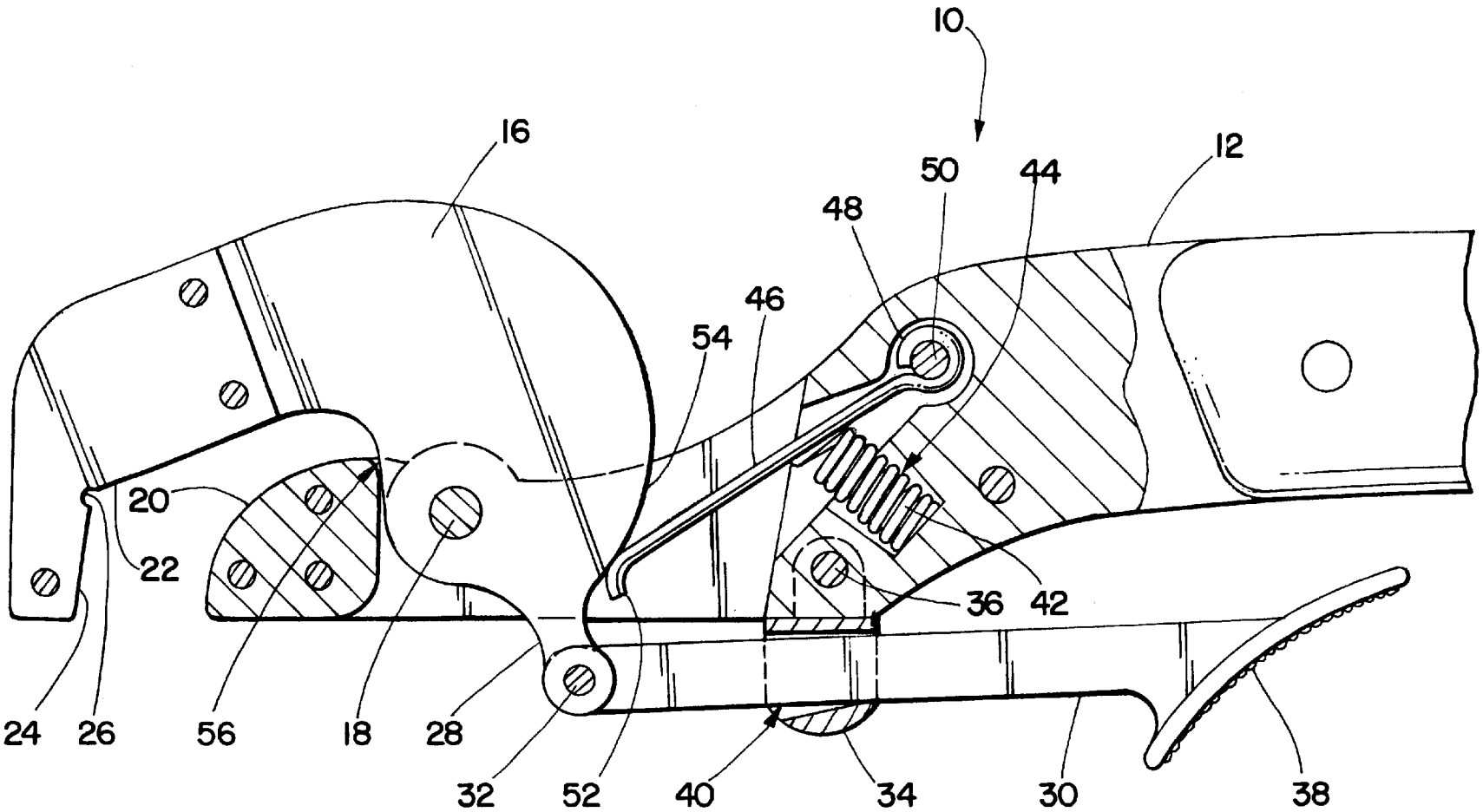
FIG. 2 is a partial side elevational view, partially in section, of the wrench shown in FIG. 1.
Figure 3:
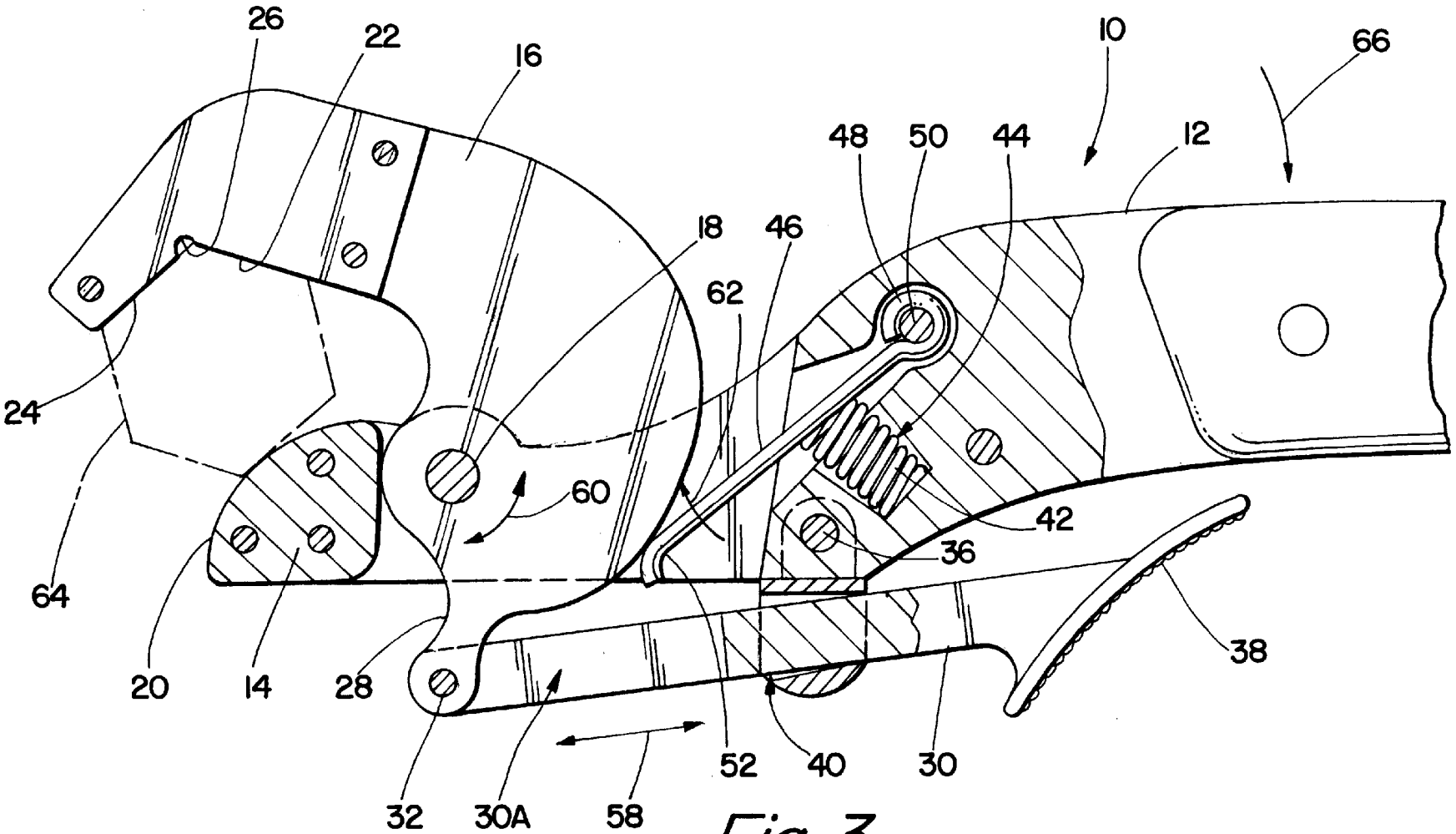
FIG. 3 is a side elevational view, similar to FIG. 2, but showing the engagement of the wrench and a fastener so as to apply torque to the fastener.
Figure 4:
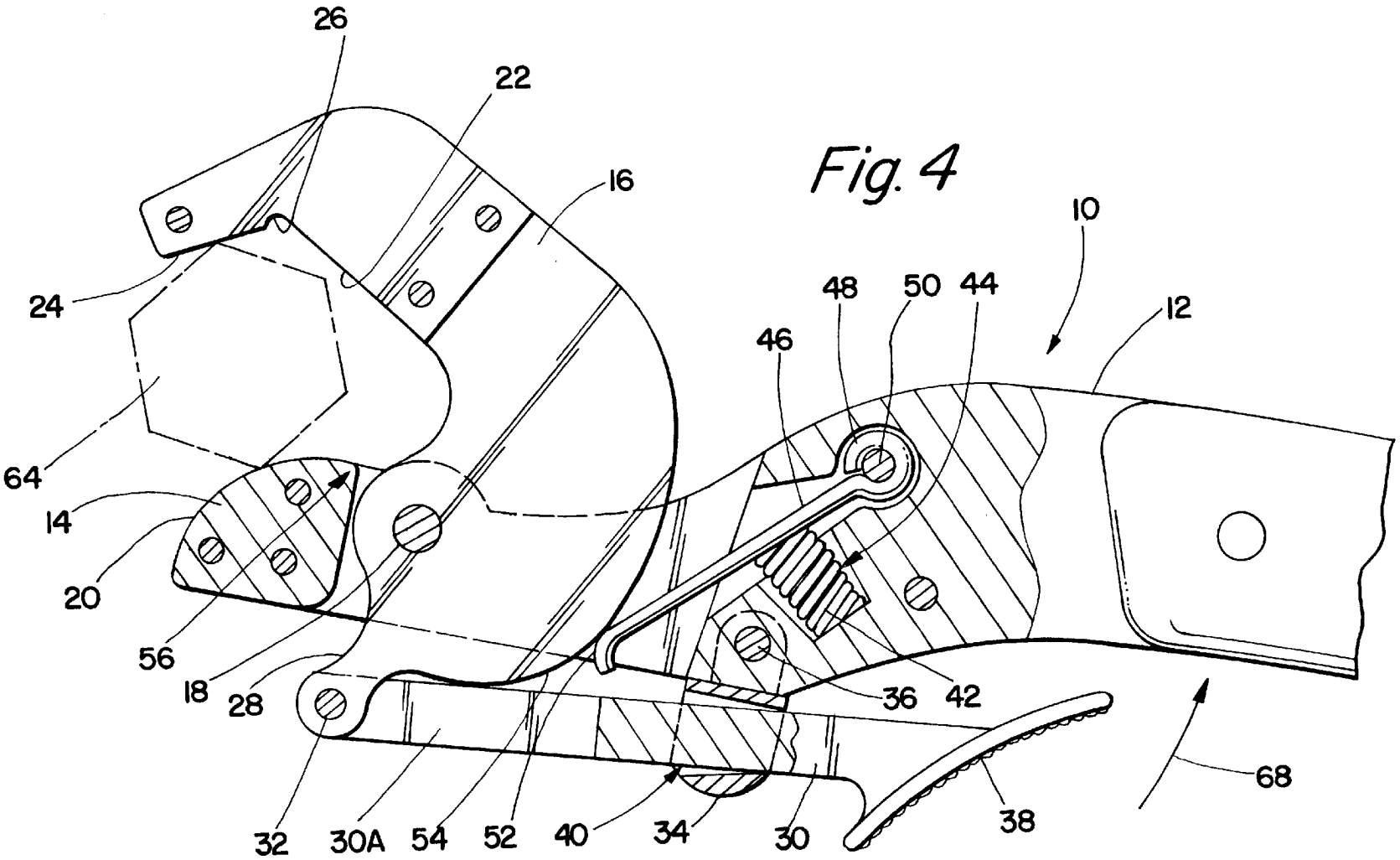
FIG. 4 is a side elevational view, similar to FIGS. 2 and 3, but showing the ratcheting of the wrench about the fastener.

As is shown in FIGS. 2, 3 and 4, the actuator bar guide 34 has a slot 40 extending therethrough, through which the actuator bar 30 extends so as to be slidable longitudinally along the handle 12 and laterally offset therefrom. A coil spring 42 is disposed in a recess 44. The coil spring 42 engages a leaf spring 46, which at one end 48, is pivotally attached to a rivet 50, and at the other end 52, slidably engages a camming surface 54 formed on the movable jaw 16.

In FIG. 2, the wrench 10 is shown in its rest position. The coil spring 42 engages the leaf spring 46, which urges the leaf spring end 52 against the camming surface 54, so as to rotate the movable jaw 16 in a counterclockwise direction until the movable jaw 16 contacts the fixed jaw 14 at a point 56, which serves as a stop against further counterclockwise rotation of the movable jaw 16.

As is indicated by the arrow 58 in FIG. 3, the actuator bar 30 may move along the longitudinal axis of the wrench 10. Manual pressure on the thumb plate 38 will cause the linear movement toward the fixed jaw 14 of rivet 32, which is the pivotal connection between the actuator bar 30 and the movable jaw tail 28, thereby causing the movable jaw 16 to rotate in a clockwise direction so as to open the space between the jaw faces 20 and 22, 24. Release of the pressure on the thumb plate 38 will cause the movable jaw element 16 to close on the fixed jaw element 14, so as to assume the position shown in FIG. 2. This rotary relative movement of the movable jaw 16 with respect to the fixed jaw 14 is illustrated by the arrow 60 adjacent the rivet 18. As was described above, the closing of the jaws results from the pressure applied by the leaf spring 46 to the camming surface 54, and the resultant planar movement of the leaf spring 46, indicated by the arrow 62.

As shown in FIG. 3, the wrench 10 has engaged a hexagonal bolt head 64 between the faces 20, 22, 24, the movable jaw 16 having rotated clockwise to enlarge the space between the jaw face 20 and the jaw faces 22, 24. Enlargement of this jaw space may be most readily accomplished by pressure on the thumb plate 38 to move the actuator arm 30 toward the fixed jaw 14. The actuator arm 30 has a bifurcation 30A formed therein to receive the camming surface 54, if necessary. When the bolt head 64 is engaged by the jaws 14, 16 as shown in FIG. 3, clockwise torque can be applied to the bolt head 64 by the manual application of such a clockwise torquing force, indicated by the arrow 66, to the handle 12.

However, if a counterclockwise torquing force is applied to the handle with the wrench 10 and bolt head 64 when in the position shown in FIG. 3, instead of torque being applied to the bolt head 64 by the jaw faces 20, 22, 24, the movable jaw 16 will move away from the fixed jaw 14. The wrench 10 will assume the disposition shown in FIG. 4, thereby permitting the wrench 10 to ratchet about the bolt head 64 in a counterclockwise direction by alternately assuming the position shown in FIG. 4 and the position shown in FIG. 3. At such time as the counterclockwise torquing force, illustrated by the arrow 68 in FIG. 4, is terminated, and a clockwise torquing force applied to the handle 10, the wrench 10 will assume and remain in the position shown in FIG. 3 for so long as the clockwise torquing force continues to be applied.

The thumb plate 38 is utilized to open the jaw faces 20, 22, 24 to receive the article to be torqued, such as the bolt head 64, or to facilitate in the removal of the wrench 10 from the article after torquing is completed. However, as is apparent from the foregoing description of the operation of the wrench 10, the wrench 10 is self-adjusting in the ratcheting phase of the torquing operation, that is, the jaw elements open automatically to permit the ratcheting of the wrench about the article being torqued and automatically close on the article to permit the application of additional torque after ratcheting.

While the operation of the wrench 10 has been described with respect to the application of torque in a clockwise direction, obviously the wrench 10 can be used to apply torque in a counterclockwise direction simply by turning the wrench over, as is conventional in the art.

Although the presently preferred embodiment of the invention has been set forth herein in detail for illustrative purposes, it will be apparent that variations and modifications thereof, including the rearrangement of parts, lie within the scope of the present invention, which is not limited to the specific structure of the embodiment shown or described herein, but only by the scope of the following claims.

The invention claimed is:

1. A self-adjusting ratcheting wrench comprising:

an elongated handle terminating at one end in a fixed jaw;

a movable jaw attached to the handle by a pivotal attachment so as to close on the fixed jaw, said movable jaw terminating at one end in a pair of jaw faces forming an obtuse angle and separated from one another by a lateral groove and at the other end in a tail, so that the pivotal attachment is disposed between the tail and the jaw faces;

an actuator arm pivotally attached at one end to the tail;

means for attaching the actuator arm to the handle so that the actuator arm is laterally offset from and longitudinally slidable along the handle;

a leaf spring disposed in the handle and having a first end and a second end;

means for pivotally attaching the leaf spring first end to the handle; and a coil spring disposed in the handle so as to engage the leaf spring to urge the leaf spring second end against a convex camming surface formed on the movable jaw adjacent the tail, whereby torque applied to the handle in a first direction causes the jaws to close on an element contained therebetween so as to apply the torque to the element, and torque applied to the handle in the opposite direction permits the jaws to open so that the wrench ratchets about the element, and longitudinal force applied to the actuator bar in the direction of the jaws causes the jaws to open.

2. A wrench according to claim 1, and in which the fixed jaw has a curvilinear face opening onto the movable jaw faces.

3. A wrench according to claim 2, and in which the movable jaw faces form an angle of one hundred and twenty degrees and are planar.

4. A wrench according to claim 3, and in which the actuator arm terminates in a thumb plate remote from its pivotal connection to the movable jaw.

5. A wrench according to claim 2, and in which the actuator arm terminates in a thumb plate remote from its pivotal connection to the movable jaw.

6. A wrench according to claim 1, and in which the movable jaw faces form an angle of one hundred and twenty degrees and are planar.

7. A wrench according to claim 6, and in which the actuator arm terminates in a thumb plate remote from its pivotal connection to the movable jaw.

8. A wrench according to claim 1, and in which the actuator arm terminates in a thumb plate remote from its pivotal connection to the movable jaw.

* * * * *